US005738552A

United States Patent [19]

Halbach et al.

[11] Patent Number: 5,738,552

[45] Date of Patent: Apr. 14, 1998

[54] BATTERY TERMINAL

[75] Inventors: Paul Gerhard Halbach, Wuppertal; Rainer Gutenschwager, Marl, both of Germany

[73] Assignee: Delphi Automotive Systems Deutschland GmbH, Wuppertal, Germany

[21] Appl. No.: 750,660

[22] PCT Filed: Apr. 17, 1996

[86] PCT No.: PCT/DE96/00670

§ 371 Date: Dec. 18, 1996

§ 102(e) Date: Dec. 18, 1996

[87] PCT Pub. No.: WO96/33525

PCT Pub. Date: Oct. 24, 1996

[30] Foreign Application Priority Data

Apr. 20, 1995 [DE] Germany ..... 295 06 699 U

[51] Int. Cl.[6] ..... H01R 4/42

[52] U.S. Cl. ..... 439/762; 439/763

[58] Field of Search ..... 439/762, 754, 439/755, 756, 757, 758, 760, 761, 763, 764, 765, 766, 767, 768, 769, 770

[56] References Cited

U.S. PATENT DOCUMENTS

| | | | |
|---|---|---|---|
| 2,935,726 | 5/1960 | Raymond | 439/765 |
| 3,407,383 | 10/1968 | Haegert | 339/230 |
| 3,409,865 | 11/1968 | Shannon | 339/227 |
| 3,739,322 | 6/1973 | Haegert | 439/764 |
| 3,893,744 | 7/1975 | Porazinski | 439/763 |
| 4,747,793 | 5/1988 | Fukuda et al. | 439/766 |
| 5,492,780 | 2/1996 | Okada | 439/765 |

FOREIGN PATENT DOCUMENTS

| | | |
|---|---|---|
| A-0632531 | 4/1905 | European Pat. Off. . |
| U-8905532 | 10/1989 | Germany . |

*Primary Examiner*—P. Austin Bradley
*Assistant Examiner*—Tho D. Ta
*Attorney, Agent, or Firm*—Cary W. Brooks

[57] ABSTRACT

In order to create a two-layer battery terminal (1) for the connection of several items of equipment and thus optimize its handling in production and installation, the connection area (5) consists of a two-layer crimp (7) and two additional connection elements (12, 13) which are arranged in extensions (14, 15, 16, 17) of the upper layer (3) and/or lower layer (4) symmetrically to the longitudinal axis (A) of the battery terminal (1).

8 Claims, 5 Drawing Sheets

BATTERY TERMINAL

FIELD OF THE INVENTION

The invention derives from a battery terminal.

BACKGROUND OF THE INVENTION

Such a two-layer battery terminal is known from the U.S. Pat. No. 5,302,143. The connection of a battery cable to the one-piece battery terminal is possible with the aid of a crimp which is also constructed in two-layers. Such a connection is able to withstand mechanical stresses and enables good current transmission. However, the battery terminal is not suited for the connection of additional users, as a corresponding connecting element is not available.

A two-layer battery terminal of this kind is known from U.S. Pat. No. 4,747,793. The connection area of this battery terminal has a threaded bolt, the fixed seat of which is provided by the embedding of the square head in the two-layered terminal. The manufacture of this single connection element requires a large amount of technical processing. Furthermore the battery terminal is suitable only for the connection of ready-made cables, wherein only one of the two layers is contacted directly. The permanence of the contact between the contact part of the cable and the battery terminal depends on the quality of the screw connection. If the nut loosens, e.g. because of operational vibrations, the single contact is made at only some points. No appropriate connection elements are provided for the connection of additional items of equipment, so that further connections would be possible only by increasing the transition resistances at the threaded bolt. The battery terminal is fixed to the battery pole by means of a screw connection, which reduces the size of the appropriate location hole. Manipulation of the components of this screw connection is made more difficult by the individuality of nut, washer and threaded bolt.

A two-layer battery terminal is also known from WO 92/11667. The cable is connected to the terminal by a crimp connection. An additional consumer may be pushed onto a projecting tongue. The disadvantage with this connection technique is that the contact can easily by loosened. When repair work is being carried out in the engine compartment, forces may be exterted, unnoticed, on the additional cable, causing the connection to be loosened. The terminal is fixed to the battery pole by the inclination of two pressed location holes with the aid of a nut and a screw, which are mounted movably to the terminal.

A battery with additional connection elements is known from U.S. Pat. No. 3,407,383. The main connection is made by means of a clamp, whereby a cable with two screws is squeezed between two metal plates. The additional connections are designed to project out from the battery terminal so that ready-made cables can be attached to them, preferably with wing nuts. Alternatively the locking screw for securing the battery terminal on the battery pole has an interior hole, into which a further screw can be inserted for securing additional cables. This connection technique requires a great deal of work so that it is not practicable for a fitter to handle this terminal, as there is very little space in the engine compartment of a motor vehicle because of the large number of pieces of equipment.

Furthermore it is known from EP 0569064 A1 that a two-layer crimp can be used to fix a cable to a contact part. A tongue projects into a single layer crimp and is squeezed together with the cable, to improve current distribution into the individual areas of the contact part.

The invention derives from the task of designing a battery terminal on the basis of the precharacterizing part of claim 1 in such a way that it is suitable for the connection of several items of equipment, while optimizing electrical and mechanical features, simplifying the manufacturing process and increasing ease of installation.

SUMMARY OF THE INVENTION

The subject matter of claim 1 has the advantage that the battery terminal creates good current transfer properties to all connection elements, and at the same time is easy to manipulate, because the stability of the terminal, in particular in the connection area, is considerably improved. The additional contact tongue of the crimp creates the precondition for an ideal current flow from the cable to the battery terminal contact points. Both layers of the battery terminal come into direct contact with the connection cable. In the connection area contact transitions are created which minimize transition resistance's and increase current carrying capacity.

The additional connection elements create the possibility of connecting several items of equipment directly and with low transition resistance's to the battery terminal. The increased current carrying capacity obviates the need for different sheet cross sections and makes it possible to manufacture the battery terminal from one material with a single material thickness. The contact tongue in the lead crimp gives the terminal additional stability and resistance to vibration after crimping. The fact that all the connection elements are grouped together in one battery terminal connection area makes for compactness and improves the stability of the terminal. The design of the connection area is easy to achieve in production. During fitting and repair work there can be unimpeded access to the locking screw, as all the connection leads are located only in the single battery terminal connection area. This prevents accidental catching.

The additional connection elements are provided in two wing-type extensions on the right and left of the main connection elements in one of the two layers. This symmetrical design of the connection area in the longitudinal direction provides a stiffening, so that the battery terminal can also withstand high stresses. The easily accessible and compact arrangement of the connection elements offers the fitter ideal working conditions. Furthermore because of the adjacent arrangement of the connection elements the cables leading out of the connection area can be simply grouped together in a loom for ease of use.

In terms of production technology, it is advantageous to make the additional connection elements by threaded bolts inserted into punched holes, because a threaded bolt provides a stable connection point. There are various techniques by which the threaded bolt can be cheaply secured and thus also functionally integrated.

Regarding ease of installation, it is desirable for the threaded bolts to be fixed into the battery terminal holes with a safety device to prevent twisting so that they cannot be lost. At the same time, care must be taken to ensure that the bond between the battery terminal and the threaded bolt does not have any adverse effect on either the electrical or mechanical characteristics.

The threaded bolt may have a square shaft underneath the head, which, when located in an appropriate punched hole, can no longer be rotated. Threaded bolts of this type, in particular with square profiles, are standard bought-in components and are correspondingly cheap. A tongue bent out from the battery terminal can grasp the threaded bolt from below to prevent it falling out of the hole and being lost.

This can be achieved in practice with very little additional work, so that the normal process sequence is not significantly affected and the production processes are maintained.

In addition to these positive-locking solutions, a non-positive locking solution is possible, with the well-known advantages. A particularly permanent bond can thus be achieved by pressing or riveting the threaded bolt to the battery terminal, whereby the threaded bolt serves ideally as a contact bridge.

It is reasonable to manufacture the battery terminals from as few individual parts as possible, to make them easier to handle. For this reason the washers are formed as one piece with the punched base part of the battery terminal and following the shaping process are placed correctly at the fitting location. All that has to be done is to insert the bolt into the correct hole and screw it into a nut.

To ensure the mechanical functions of the battery terminal, it is important that its shape be maintained permanently. Therefore in the central area of the battery terminal support lugs are punched out on both layers so that they abut against one another. The battery terminal is thus stabilised in the area of the connection holes and their mutual alignment is ensured. This makes it possible to plug the battery terminal onto the battery pole easily. Furthermore the two layers can be locked one to the other by means of hooks and projections. This prevents the layers being opened or bent apart, particularly when the battery terminal is pulled off the battery pole.

The invention is now explained using an embodiment and with the aid of drawings.

DETAILED DESCRIPTION

Figure 1:
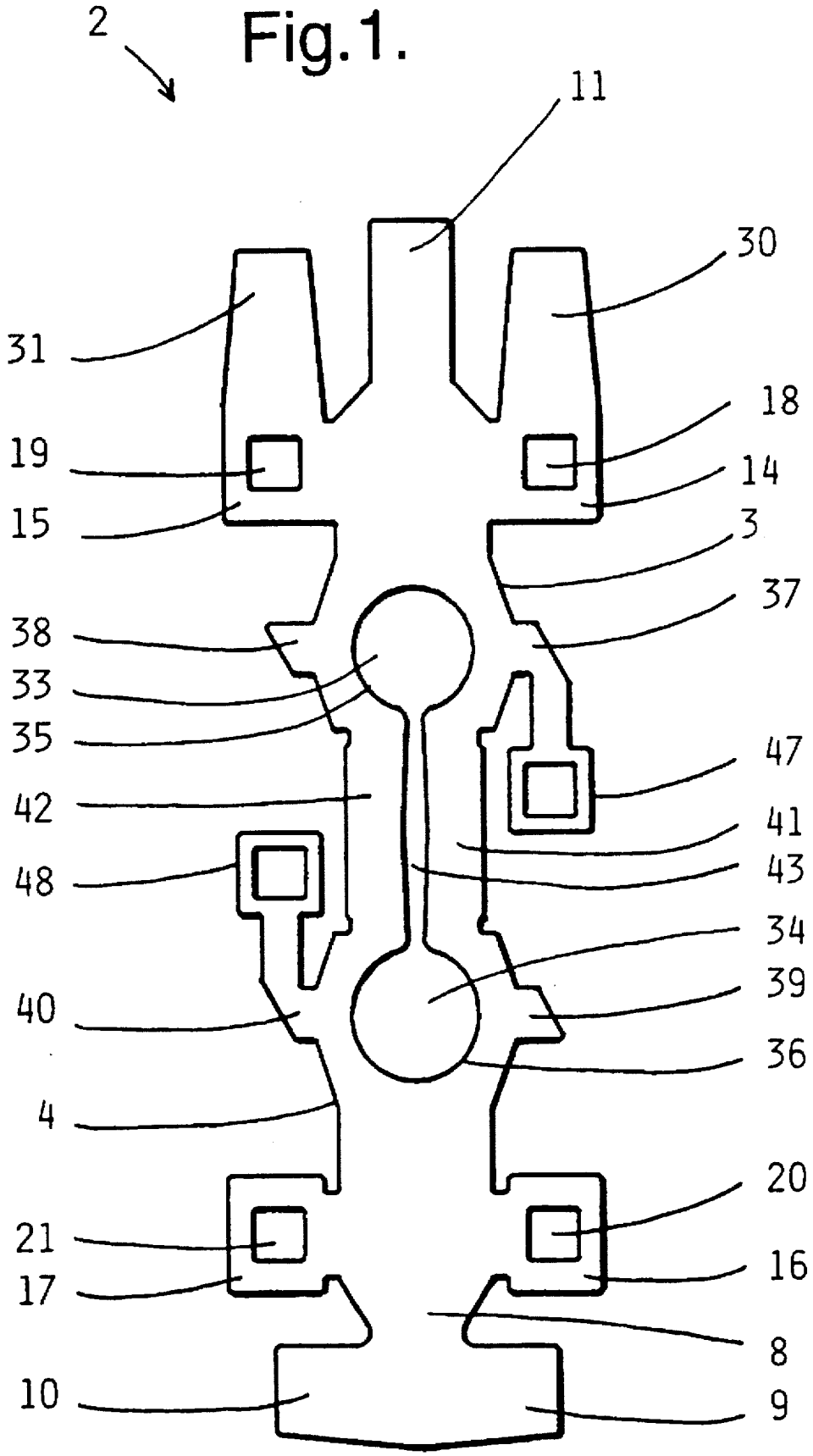
FIG. 1 shows a punched out metal blank for a battery terminal.
Figure 6:
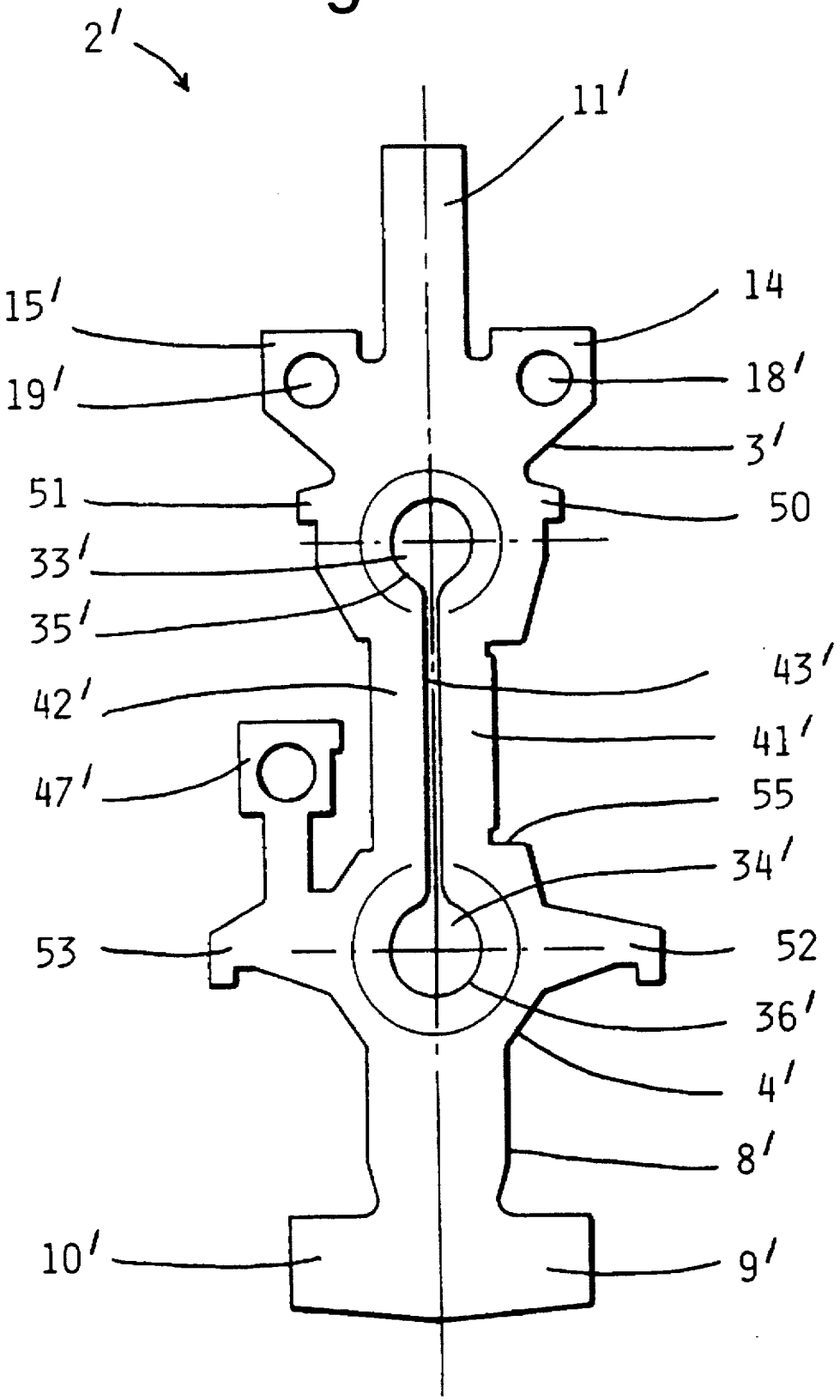
FIG. 6 shows a punched out metal hole for a further embodiment of a battery terminal.
Figure 7:
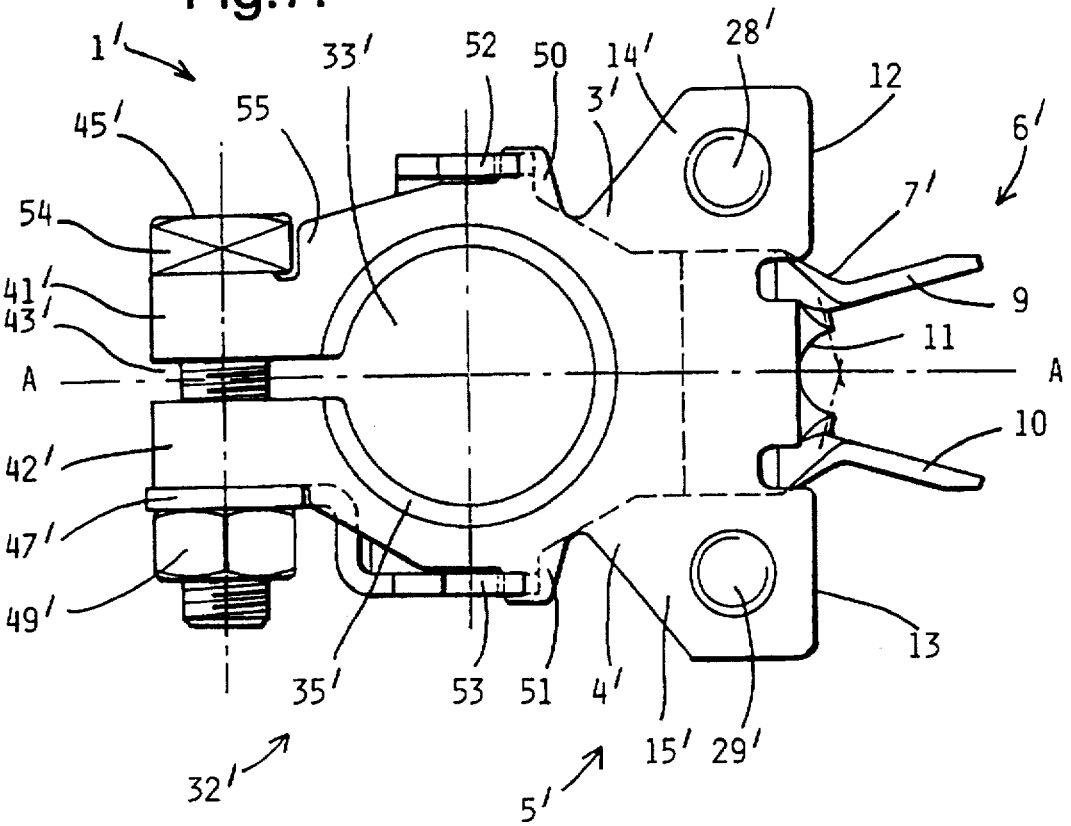
FIG. 7 shows the battery terminal in plan view, made from the blank according to FIG. 6, with threaded bolts inserted.
Figure 8:
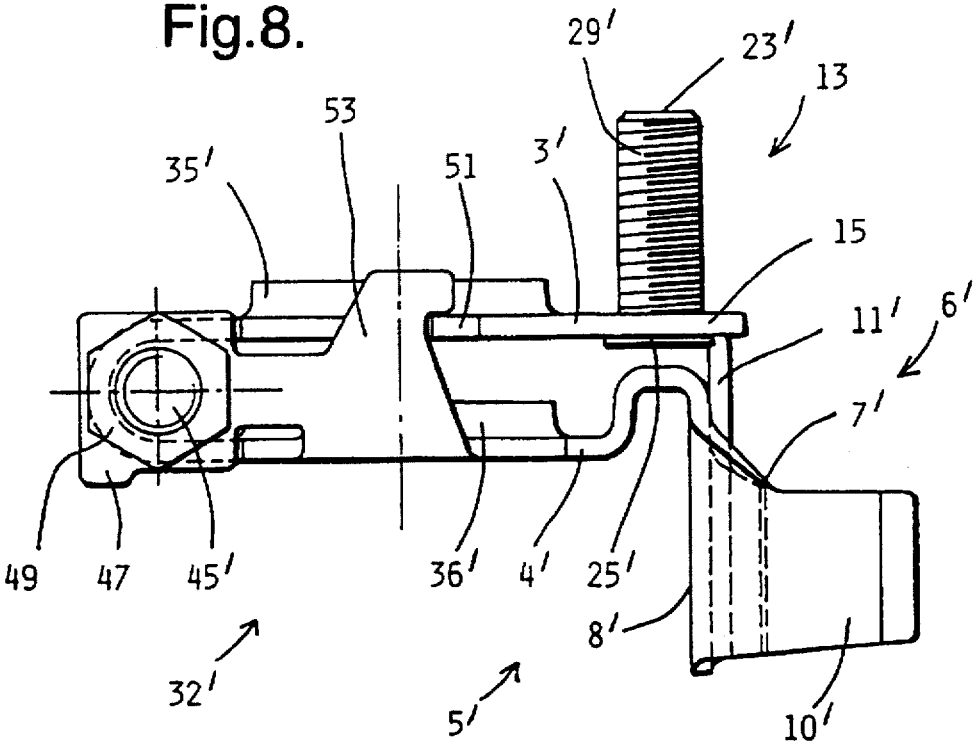
FIG. 8 shows the battery terminal according to FIG. 7, side view.

FIGS. 1 and 6 show metal blanks of battery terminals 1 and 1' to scale 1:1, while the battery terminals 1 and 1' in the other figures are to scale 2:1. The two embodiments differ from one another only in a few details, so that the same components in the second embodiment according to FIG. 6 to 8 are designated with the same reference numbers, but with an apostrophe added. Essentially the battery terminals 1 and 1' can be used for contacting both the plus and minus pole of a battery.

The diameter of the plus pole of a battery is greater than the minus pole, so that appropriate battery terminals 1 and 1' have the same construction, but pole locations with different dimensions. The following description refers to the contacting of the plus pole.

Figure 2:
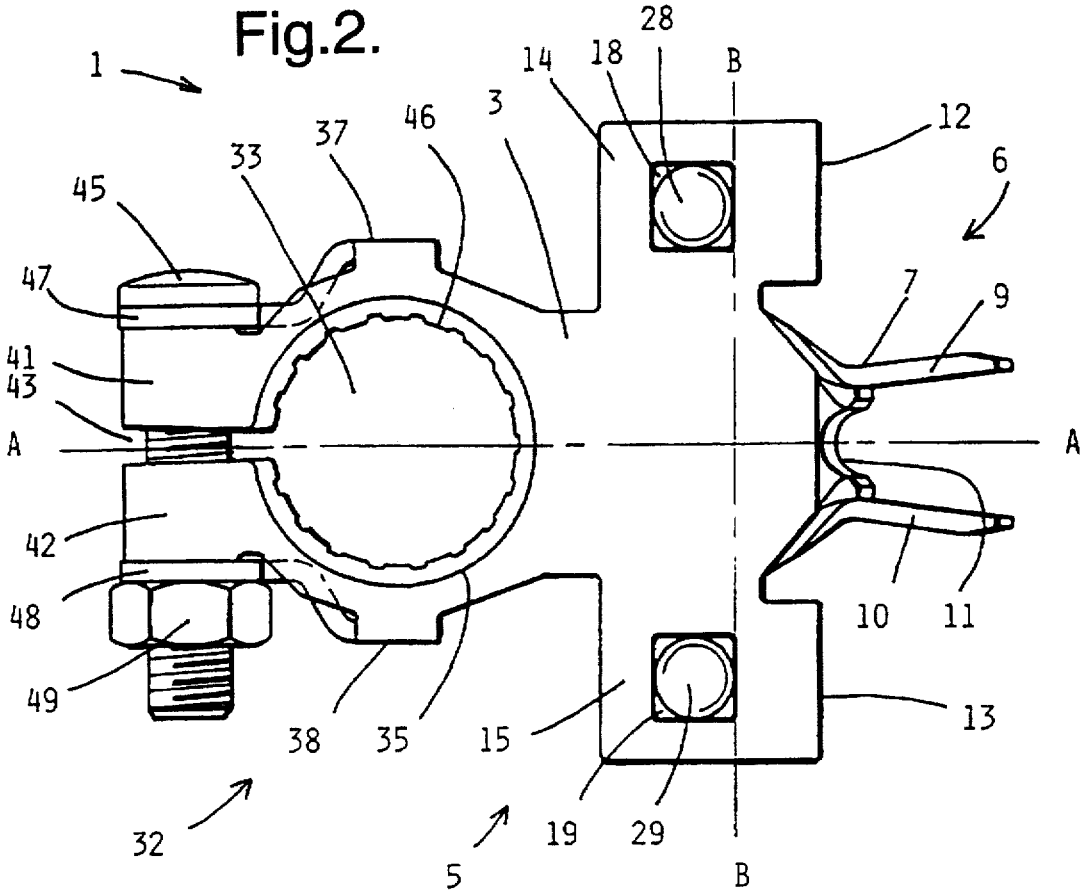
FIG. 2 shows the battery terminal in plan view, made from the blank according to with FIG. 1 with threaded bolts inserted.
Figure 3:
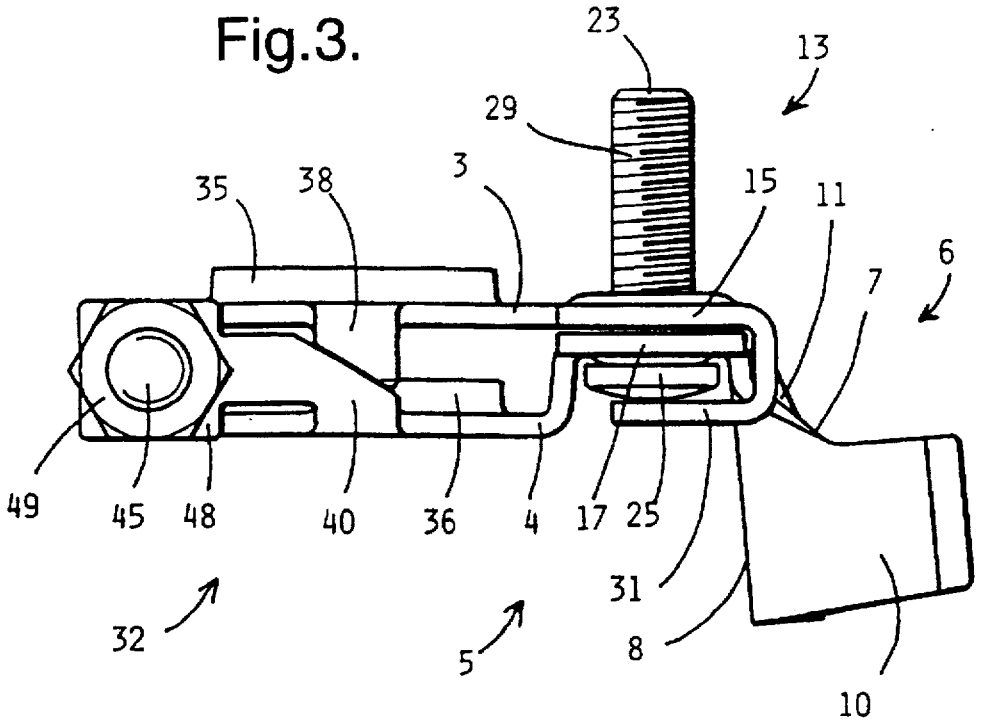
FIG. 3 shows the battery terminal according to FIG. 2, side view.

FIG. 1 shows a flat base part 2, from which, following various shaping steps, the finished battery terminal 1 is made according to FIGS. 2 and 3. The single-piece base part 2 is punched out of a sheet of copper zinc alloy, and is essentially rectangular in shape. The use of a single-piece base part 2, which structurally requires only one single material thickness, means that the battery terminal 1 complies with the general effort to reduce weight. In order to create a two-layer battery terminal 1 the flat base part 2 is bent through 180°, to create an upper layer 3 and lower layer 4, with a gap between them, as shown in FIG. 2. The battery terminal 1 is manufactured from the base part 2 by further stamping, bending and assembly processes.

Figure 4:
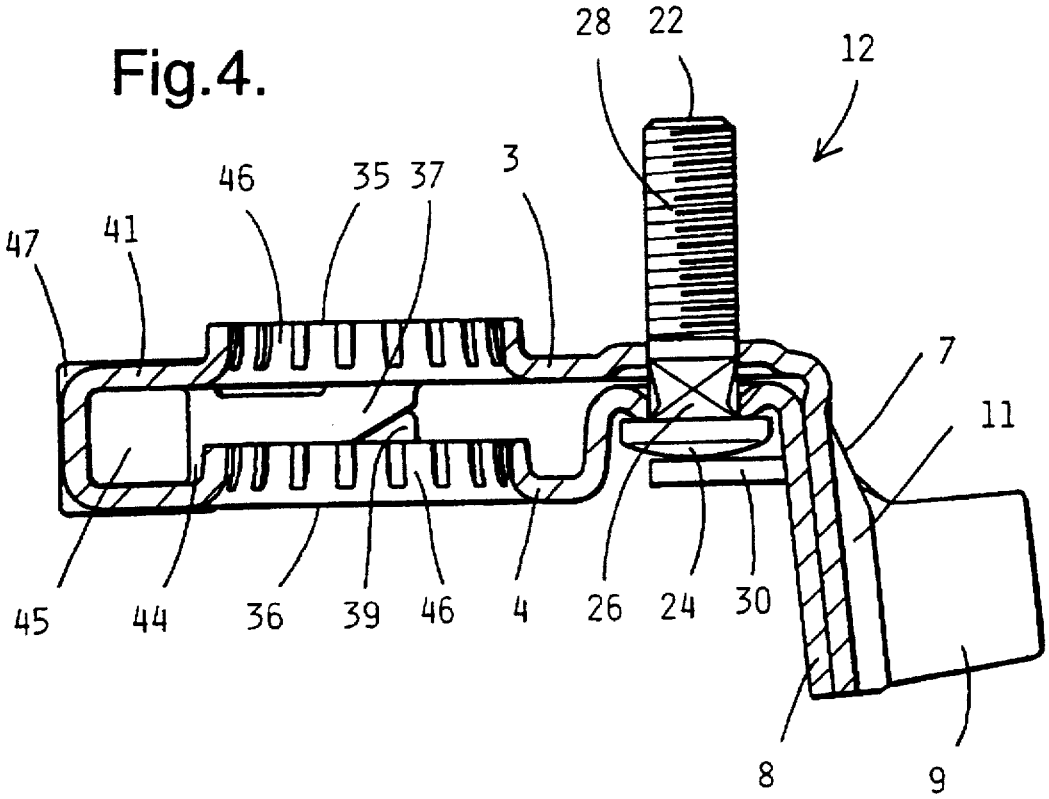
FIG. 4 shows the battery terminal in section through the longitudinal axis A—A in FIG. 2.
Figure 5:
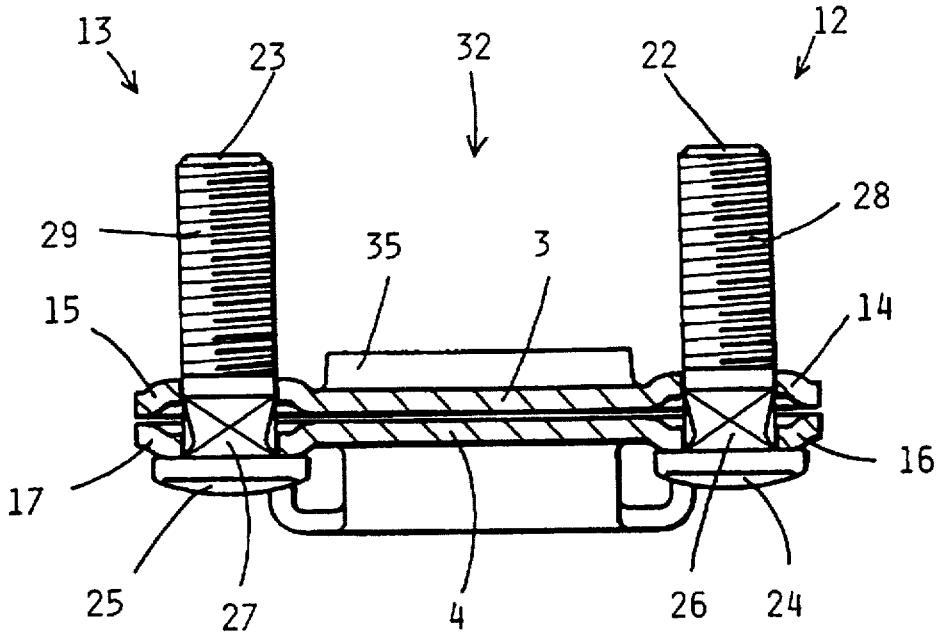
FIG. 5 shows the connection area of the battery terminal in section through the line B—B in FIG. 2.

In a connection area 5 located on the right hand side in FIGS. 2 to 4, the battery terminal 1 can be connected with cables, not shown. The main connection cable is fixed to the first connection element 6 of the battery terminal 1. Connection element 6 consists of a two-layer crimp 7. To form the crimp 7 a cable holder 8 with claws 9 and 10 formed on both sides is bent at right angles from the lower layer 4. An additional contact tongue 11 is bent at right angles from the upper layer 3 and lies in the cable holder 8. After the crimp 7 has been squeezed around a part of the cable from which the insulation has been removed the claws 9 and 10 press into the cable conductor bunch and provide a non-positive, permanent attachment. The cable holder 8, its claws 9 and 10 and the contact tongue 11 surround the cable conductors and serve for current transfer.

The use of a two-layer crimp 7 thus makes it possible to have greater current carrying capacity while at the same time reducing the amount of heat produced, because both the upper layer 3 and the lower layer 4 are contacted directly. This feature is particularly important for the battery terminal 1 which is subject to high current loadings. Furthermore the contact tongue 11 affords additional stability and resistance to vibration for the battery terminal 1.

As part of the connection area 5 there are two additional connection elements 12 and 13 arranged symmetrically for appropriate items of equipment, e.g. a radio. The upper layer 3 and the lower layer 4 are designed to have extensions 14, 15, 16 and 17 on both sides of the longitudinal axis of the battery terminal 1, and a square hole 18–21 is punched out of each extension to take two threaded bolts 22 and 23. The threaded bolts 22 and 23, under their lenticular head 24 and 25 have square shafts 26 and 27, which change into threaded pins 28 and 29. Because of the positive-locking nature of the square holes 18–21 and the square shafts 26 and 27, the threaded bolts 22 and 23 are located in the battery terminal in such a way that they cannot twist. Furthermore on the upper layer 3 at the extensions 14 and 15 there are retaining tongues 30 and 31, which are bent down with the threaded bolts 22 and 23 and grasp the heads 24 and 25 from below after the battery terminal has been assembled. This means that the threaded bolts 22 and 23 are secured against falling out.

This facilitates the fitting of the cables. A ready-made cable, e.g. with a cable terminal, can be secured with a nut without entrained rotation and without securing the threaded bolts 22 and 23. The completely flat contact transitions from the nut to the tongues 30 and 31 make for extremely low transition resistance's and improve the electrical characteristics of the battery terminal 1.

Furthermore the symmetrical and centralised arrangement of the connection elements 6, 12 and 13 create a clearly defined and sufficiently stable connection area 5, which offers installation advantages.

In a terminal area 32 located to the left of the connection area 5, there is a circular slot location hole 33, 34 in both the upper layer 3 and the lower layer 4, for the battery pole (not shown). The edges 35 and 36 of the location holes 33 and 34 are moulded and point upwards. So that the battery terminal 1 can be fitted easily on the battery pole, the two location holes 33 and 34 are aligned with one another. In order to ensure the stability of the battery terminal 1 when fitting and removing, support lugs 37–40 are formed on the upper layer 3 and on the lower layer 4 on both sides of the longitudinal axis A outside at the holes 33 and 35. The gap between the two layers 3 and 4 is thus guaranteed, so that there can be no distortion during fitting or removal.

The upper layer 3 and the lower layer 4, with a gap between them, are joined to one another in the longitudinal direction A by two bridges 41 and 42 bent in a U shape, to form one piece. The two bridges 41 and 42 end at the two location holes 33 and 34 respectively. Between these two bridges 41 and 42 there runs a slot 43, which opens onto the location holes 33 and 34 and their edges 35 and 36. A screw 45 is inserted in a tubular cavity 44 between the layers 3 and 4 adjacent to the U-shaped bridges 41 and 42, which screw can be used to narrow the slot 43 between the bridges 41 and 42. Consequently the circumference of the location holes 33 and 34 is also reduced and the edges 35 and 36 are pressed against the battery pole. The battery terminal 1 is secured to the battery pole. Contact is made between the battery pole and the edges 35 and 36 and can be improved by the projecting button 46.

Fitting the battery terminal 1 requires the individual components of a screw connection to be brought together. This is facilitated by the single-piece arrangement of the washers 47 and 48 on the base part 2 of the battery terminal 1. From the outset in the manufacturing process the washers 47 and 48 are placed at the fitting location directly in front of and behind the cavity 44 for the bolt 45 and cannot be lost. In the embodiment the washers 47 and 48 are formed at the support lugs 37 and 39. A further improvement is achieved here again by the use of a square bolt 45. Suitably bent bridges 41 and 42, which delimit the cavity 44 to house the bolt 45, prevent the bolt 45 twisting, so that only one tool is required to turn the nut 49, in order to secure the battery terminal 1 to the battery pole.

The structural design of the battery terminal 1 allows for simple and low cost manufacture.

The battery terminal 1' shown in FIGS. 6 to 8 differs from the embodiment according to FIGS. 1 to 5 only in details, but the basic construction is identical. The additional connection elements 12' and 13' are designed to have only one layer, because the threaded bolts 22' and 23' are secured to the upper layer 3' in a non-positive manner. No arrangements are necessary to prevent the threaded bolts 22' and 23' from twisting and being lost. These features are provided in the process technology by riveting or pressing.

The distance between the upper layer 3' and the lower layer 4' is maintained not by support elements 37–40 abutting against one another, but by complementary hooks 50, 51 and projections 52, 53, which lock the two layers 3' and 4' to each other. The battery terminal 1' cannot be bent apart by the forces normally exterted during fitting.

As can be seen from FIG. 7, the screw 45' co-operates with only one washer 47', but this is also bound to the base part 2' to form one single part. The screw 45' is secured against twisting by the square screw head 54, which is prevented from twisting by a corresponding stop 55 on the battery terminal 1'.

List of references

1 Battery terminal
2 Base part
3 Upper layer
4 Lower layer
5 Connection area
6 Connection element
7 Crimp
8 Cable holder
9 Claw
10 Claw
11 Contact tongue
12 Connection element
13 Connection element
14 Extension
15 Extension
16 Extension
17 Extension
18 Hole
19 Hole
20 Hole
21 Hole
22 Threaded bolt
23 Threaded bolt
24 Head
25 Head
26 Shaft
27 Shaft
28 Threaded pin
29 Threaded pin
30 Retaining tongue
31 Retaining tongue
32 Terminal area
33 Location hole
34 Location hole
35 Edge
36 Edge
37 Support lug
38 Support lug
39 Support lug
40 Support lug
41 Bridge
42 Bridge
43 Slot
44 Cavity
45 Bolt
46 Button
47 Washer
48 Washer
49 Nut
50 Hook
51 Hook
52 Projection
53 Projection
54 Bolt head
55 Stop A Longitudinal axis

We claim:

1. Two-layer, single-piece, electrical battery terminal (1), stamped and shaped from metal sheet with a terminal area (32) designed for connection to one pole of a motor vehicle battery, consisting of an upper layer (3) with a moulded, slot location hole (33), a lower layer (4), separated by a gap from the upper layer (3), which lower layer (4) has a moulded, slot location hole (34), two bridges (41, 42), bent into a U-shape, linking the upper layer (3) with the lower layer (4), a cavity (44) formed between the upper layer (3) and the lower layer (4) bordering the bridges (41, 42), into which a screw (45) can be inserted, which by reducing the size of the location holes (33, 34) secures the battery terminal (1) on the pole, and with a connection area (5) fitted with at least a first connection element (6) for the connection of electrical cables, a bent-down, two-layer crimp (7) consisting of a cable holder (8) formed from the lower layer (4) and a contact tongue (11) projecting into the cable holder (8) and formed in the upper layer (3), characterized in that a second and a third connection elements (12, 13) are arranged in the connection area (5), whereby the upper layer (3) and/or the lower layer (4) are each formed with two extensions (14, 15, 16, 17) with punched holes (18, 19, 20, 21), into which threaded bolts (22, 23) can be fitted, and that the first connection element (6) is arranged along a longitudinal axis (A) and the second and third connection element (12, 13) are arranged symmetrically to the longitudinal axis (A) of the battery terminal (1).

2. Battery terminal according to claim 1, characterized in that the threaded bolts (22, 23) have a square shaft (25, 26).

3. Battery terminal according to claim 1, characterized in that the threaded bolts (22, 23) are surrounded by bent-down retaining tongues (30, 31) of the upper layer (3) or lower layer (4).

4. Battery terminal according to claim 1, characterized in that the threaded bolts (22, 23) are pressed.

5. Battery terminal according to claim 1, characterized in that the threaded bolts (22, 23) are riveted.

6. Battery terminal according to claim 1, characterized in that at least one washer (47, 48) for the screw (45) is bound as a single piece with the upper layer (3) of the lower layer (4).

7. Battery terminal according to claim 1, characterized in that two support lugs (37, 38, 39, 40) are arranged at each of the upper layer (3) and layer (4), which support lugs co-operate in such a way that the upper layer (3) and the lower layer (4) are fixed to one another.

8. Battery terminal according to claim 1, characterized in that complementary hooks (50, 51) and projections (52, 53) are formed at the upper layer (3) and at the lower layer (4), locking the upper layer (3) and the lower layer (3) to each other.

* * * * *